United States Patent [19]

Gossage

[11] 4,407,475

[45] Oct. 4, 1983

[54] RECREATIONAL TABLE

[76] Inventor: John R. Gossage, 7924 Green Moss Glen, Severn, Md. 21144

[21] Appl. No.: 231,939

[22] Filed: Feb. 5, 1981

[51] Int. Cl.[3] ..... A47B 37/04; A47B 3/00

[52] U.S. Cl. ..... 248/156; 108/5; 108/116

[58] Field of Search ..... 108/116, 27, 5; 248/156

[56] References Cited

U.S. PATENT DOCUMENTS

| | | | |
|---|---|---|---|
| 727,438 | 5/1903 | Piner | 108/5 |
| 1,898,666 | 2/1933 | Isaacson | 108/27 X |
| 2,643,843 | 6/1953 | Brown | 248/156 |
| 2,877,828 | 3/1959 | Barrette | 248/156 X |
| 2,986,438 | 5/1961 | Smathers et al. | 108/116 |
| 3,006,706 | 10/1961 | Park et al. | 108/116 |
| 4,098,478 | 7/1978 | Spitzke | 248/156 |

*Primary Examiner*—Francis K. Zugel

*Attorney, Agent, or Firm*—Harvey B. Jacobson

[57] ABSTRACT

A recreational table for use on the beach comprises a pivotally mounted table top attached to a telescoping pedestal which contains a lower tapering end for inserting and stabilizing the table within the sand. By forming the pedestal from a pair of telescoping members and by pivotally mounting the table top on the upper telescoping member, the recreational table can be folded and collapsed into a unit which can be easily carried and stored, the table top optionally containing a handle member.

4 Claims, 5 Drawing Figures

RECREATIONAL TABLE

BACKGROUND OF THE INVENTION

1. Field of the Invention

This invention relates to portable tables and more particularly to inexpensive tables for use at the beach.

During the summer months, it has become a very popular custom to go to an ocean beach relaxing in the sunshine and ocean waters. For many, it is desirable to bring along refreshments for quenching the thirst, reading materials, radios, etc., for spending most of the entire day relaxing on the sand. While the beach blanket is a comfortable way of relaxing on the sand, ocean winds often blow the sand along the surface of the beach, and onto the blanket which can be harmful to the portable radios, or the like, can gather within the pages of books and magazines and even blow into the refreshments which are placed on the blacket surface. While some sun bathers accept this fate, others find it a nuisance and bring along foldable chairs and upright stands and small tables to rest any goods which are brought to the beach. Unfortunately, presently known small tables are not very portable, do not fold to allow easy carrying and are not versatile enough to securely hold the goods which are brought to the beach. Accordingly, there is a need for a portable recreational table which can be taken to the beach and used to securely hold the variety of objects which sun bathers like to take for spending a relaxing day at the beach.

2. Disclosure Statement

A table comprising a table top pivotally attached to a pedestal for movement between a horizontal position and a substantially vertical position is disclosed in U.S. Pat. No. 3,993,004, issued Nov. 23, 1976, to Alme. The pivotal table top in this patent is provided so that the table will take up less space in storage. The pedestal on which the table top rests is not retractable and thus not practicable for use in carrying to the beach or setting up in the soft beach sand. U.S. Pat. No. 2,526,011, issued Oct. 17, 1950, to Ely and U.S. Pat. No. 2,805,109, issued Sept. 3, 1957, to Kopmar, disclose recreational beach tables, but do not disclose a portable table in which the table top is pivotally mounted to a telescoping pedestal which can be arranged in a manner for easy carrying. Likewise, U.S. Pat. No. 2,937,761, issued May 24, 1960, to Reed, discloses a utility stand which is portable but does not contain the pivotal table top or telescoping pedestal which enables the stand to be contracted to an easily carriable form. U.S. Pat. No. 2,877,828, issued Mar. 17, 1959, to Barnette, discloses a folding fisherman's seat which includes a flat seat pivotally mounted to the upper end of a support staff assembly, the staff assembly formed in two parts which can be easily fitted together but which do not form a telescoping assembly, nor is the seat capable of safely holding a plurality of receptacles, such as liquid refreshments to quench the thirst. Accordingly, prior art tables or stands have not included all the desirable features which enable a recreational table to be easily carried and set up on the beach and which will provide adequate space and safe and convenient holding of objects taken along so that a day at the beach can be an enjoyable and relaxing experience.

SUMMARY OF THE INVENTION

In accordance with the present invention, a recreational table is provided which comprises a table top pivotally attached to one end of a telescoping pedestal, the table top pivotal between a horizontal and a vertical position, the pedestal being tapered at the end furthest from the table top to allow the table to be inserted into soft beach sand. The table top can include a plurality of recesses which are able to securely hold a plurality of objects, such as beverage containers. The table top also includes a ledge at one end so that when the table top is in the vertical position or a position inclined toward the vertical, objects such as magazines, books, or small food articles can be securely held on the table. The recreational table of the present invention can be easily carried from place to place by pivoting the table top in the vertical position and moving the sections of the telescoping pedestal within each other to provide a compact table easy to carry or store.

Accordingly, it is an object of the present invention to provide a recreational table which is easily portable, light in weight and simple to manufacture.

It is a further object of the invention to provide a recreational table which can be used simply and efficiently at the beach, which is versatile enough to hold a wide variety of objects securely and which can be arranged in compacted form for easy transportation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
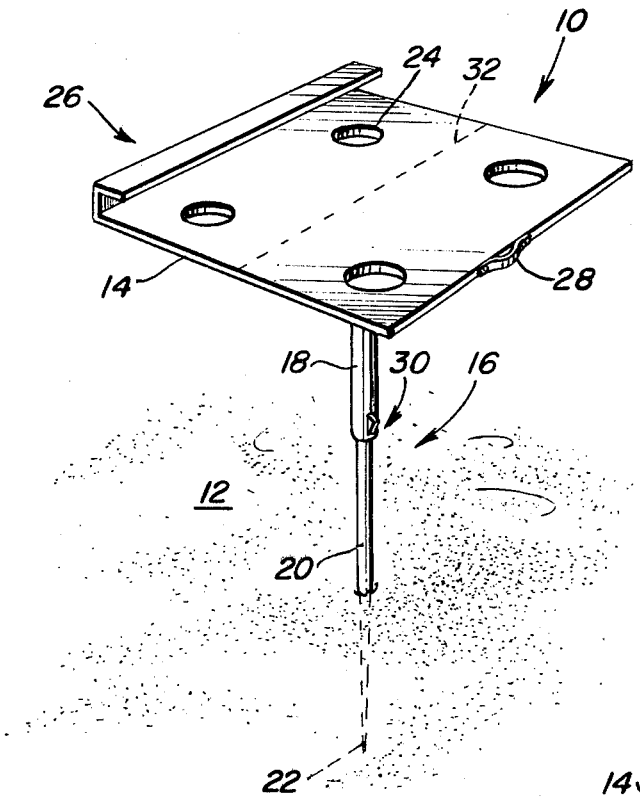
FIG. 1 is a perspective view of the recreational table of the present invention shown securely supported in the sand.

In FIG. 1, recreational table generally indicated by reference numeral 10 is set up for use in beach sand 12. Table 10 includes table top 14 pivotally mounted to telescoping pedestal assembly 16 comprising upper pedestal member 18 and lower pedestal member 20. Lower pedestabl member 20 tapers at end 22 to a point for insertion into sand 12 deep enough to rigidly secure the table in sand 12 without being moved by the wind.

Table top 14 contains a plurality of recesses 24 for securely holding a plurality of objects, such as beverage containers, when table top 14 is in the horizontal position. At one edge of table top 14 is placed shelf 26 which can be used to hold objects taken to the beach, particularly when table top 14 is in the vertical position. Placed on the opposite edge of table top 14 opposed to shelf 26 is handle 28 by which table 10 can be carried once table 10 is put in the arrangement depicted in FIG. 3. A biased latch mechanism 30 holds pedestal assembly 16 in either the fully retracted position shown in FIG. 1 or the fully contracted position shown in FIG. 3. Dotted line 32 placed across table top 14 illustrates a possible optional feature of the present invention in which table top 14 can be folded in half, possibly by means of conventional hinges placed across dotted line 32. Such an arrangement would greatly increase the compactness of recreational table 10.

Figure 2:
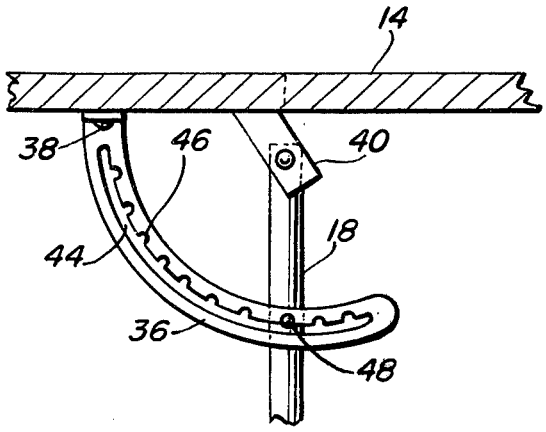
FIG. 2 is fragmented cross-sectional view illustrating the pivotal attachment of the table top to the telescoping pedestal, the table top in the horizontal position.
Figure 3:
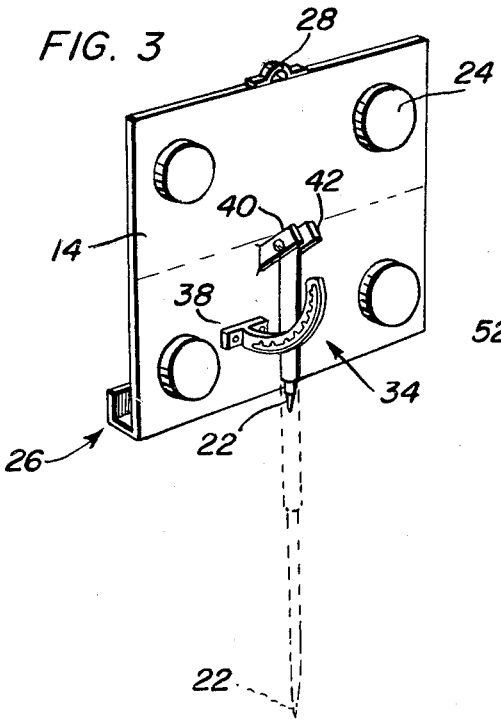
FIG. 3 is a perspective view illustrating the table of the present invention in the fully closed or compacted arrangement for storage or transportation, the dotted line indicating the expanded position of the telescoping pedestal.
Figure 4:
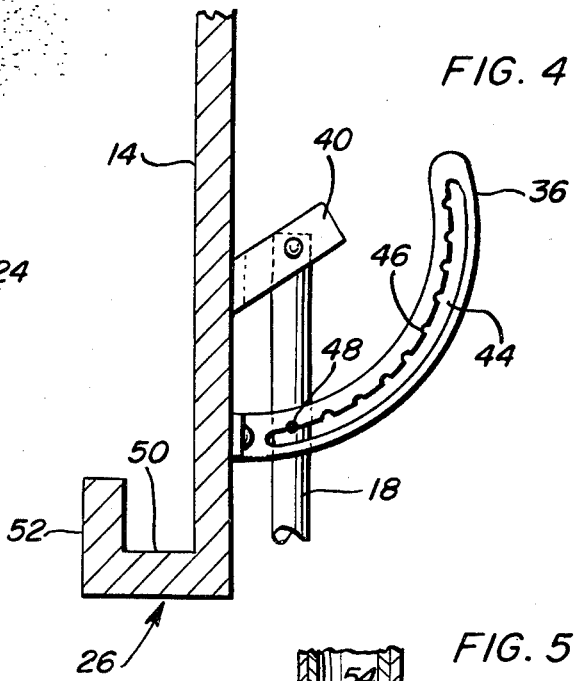
FIG. 4 is a fragmentary cross-sectional view illustrating the pivotal arrangement of the table top on the pedestal, the table top in the vertical position and also showning the positioning of the table top shelf.

Referring in detail to FIG. 3, pivot assembly 34 is provided for positioning table top 14 in the horizontal and vertical positions. Recreational table 10 is shown in the fully collapsed or compact position in which table top 14 is in the vertical position and pedestal assembly 16 is fully contracted in which lower pedestal member 20 is enclosed within upper pedestal member 18. As can be seen, pedestal assembly 16 does not extend beyond table top 14 when table 10 is arranged in the compacted position for transportation or storage. Recreational table 10 is easily carried to and from or across the beach by engaging handle 28. Pivot assembly 34 as further illustrated in FIGS. 2 and 4 comprises resilient sector arm 36 mounted by any conventional means such as a pair of screws 38 to the underside of table top 14 and which extends adjacent to upper pedestal member 18. Pivotally mounted and secured to upper pedestal member 18 is a pair of holding brackets 40 and 42, the top edge of each holding bracket contacting the underside of table top 14. Sector arm 36 is in the shape of an arc positioned substantially parallel to the arc formed when table top 14 is pivoted from the horizontal to vertical position. Contained within sector arm 36 is an arcuate slot 44 extending substantially throughout the total length of arm 36. Slot 44 contains a plurality of detent slots 46 offset but communicating with arcuate slot 44, detent slots 46 being uniformly spaced from each other along substantially the entire length of slot 44. Attachment post 48 contained on upper pedestal assembly 18 is capable of sliding within slot 44 relative to each of detent slots 46. By placing attachment post 48 within a particular detent slot 46, table top 14 is locked in place. As can be determined, the plurality of detent slots 46 along substantially the entire length of slot 44 allows table top 14 to be positioned substantially within any incline from horizontal to vertical. The position of table top 14 is simply changed by lifting (flexing) sector arm 36 to release attachment post 48 from a particular detent slot 46 so that attachment post 48 is free to move along slot 44, moving table top 14 to the desired position and letting arm 36 fall whereby attachment post 48 moves into another detent slot 46 directly above attachment post 48. FIGS. 2 and 4 illustrate the positions of each component of pivot assembly 34 when table top 14 is in the horizontal and vertical positions, respectively. It should be noted that any type of pivot assembly other than that illustrated in FIGS. 2 through 4 can be utilized. Any pivot assembly must be able to pivot table top 14 in a vertical position substantially parallel to the longitudinal axis of pedestal assembly 16 and should preferably lock table top 14 in substantially any position from the horizontal to the vertical.

FIG. 4 illustrates another feature of recreational table 10 which differs from such tables manufactured in the past. Placed along one edge of table top 14 is shelf 26 formed by ledge 50 and upturned edge 52. When table top 14 is in the vertical position or in a position substantially to the vertical, books, magazines, etc., can be placed on ledge 50 and held in place between table top 14 and upturned edge 52. Such a magazine or book can be held on table 10 without being held in the hands of the reader. Likewise, towels, small packages and other objects can be placed on ledge 50 during transport of table 10.

Figure 5:
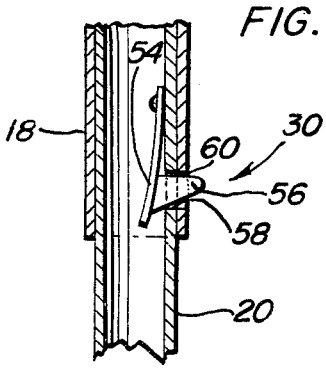
FIG. 5 is an enlarged cross-sectional view illustrating the telescoping pedestal of the table, including the latch mechanism to expand or contract the telescoping pedestal.

FIG. 5 illustrates biased latch mechanism 30 which is manipulated to expand and contract telescoping pedestal assembly 16. Placed on the inner surface of lower pedestal member 20 is a bias or tension strip 54 which urges latching post 56 outwardly through slot 58 formed in lower pedestal member 20 and in contact with the inside surface of upper pedestal member 18. Placed in upper pedestal member 18 are a series of slots 60, preferably two in number, one at the bottom and one toward the end of upper pedestal member 18 adjacent pivot assembly 34 which, when aligned with slot 58, will receive latching post 56 and hold pedestal members 18 and 20 in place. By pushing latching post 56 within slot 60 enables pedestal members 18 and 20 to move relative to one another for movement in the expanded or contracted positions. Any other conventional telescoping mechanism may be utilized, but it is important that the telescoping pedestal assembly contract to an easily carried form and must not be such that the individual members must be taken apart and placed back together again for each time of use.

The materials of construction of recreational table 10 are preferably lightweight plastics or metals or a combination of the two. Such materials should be able to withstand the abrasive action caused by blowing sand and must be strong enough to withstand the weight that will be placed upon such tables when used for relaxing at the beach. Corrosion resistant materials are also preferred.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A recreational table including a horizontal table top including upper and lower surfaces, remote opposite marginal edge portions and a mount centrally located between said remote edge portions and projecting downwardly from said lower surface, an elongated, telescopically longitudinally extendable and retractable pedestal assembly having one end portion pivotally supported from said mount for angular displacement about an axis transverse to said pedestal assembly and a path extending between said remote edge portions, said pedestal assembly and said top including coacting means operatively associated with each other limiting angular displacement of said top relative to said pedestal assembly to approximately 90° between a first position with said top disposed generally normal to said pedestal assembly and a second position with said top generally paralleling and closely adjacent said pedestal assembly, one of said remote edge portions including handle means and the other of said remote edge portions including a ledge extending therealong and projecting outwardly from said upper surface, said ledge terminating outwardly in an inturned free edge portion projecting inwardly over said upper surface in spaced relation relative thereto, said coacting means including a resilient arcuate slotted sector arm rigidly secured at one end to the lower surface of said top and a laterally outwardly projecting pin carried by said pedestal assembly slidably received in said slot and bearing against the edge of said arm defining one side longitudinal marginal portion of said slot, said edge of said arm having longitudinally spaced notches formed therein in which said pin may be selectively removably seated.

2. The table of claim 11 wherein said telescoping pedestal assembly is formed from a plurality of relatively telescoped pedestal members, the pedestal member furthest away from the mounting point of said table top including a tapered end for insertion into the ground.

3. The table of claim 2 wherein said telescoping pedestal assemby is retractable so as to not extend substantially beyond said other of said remote edge portions of said table top when said table top is pivoted in the vertical position adjacent and substantially parallel to said pedestal assembly.

4. The table of claim 3 wherein said table top includes a plurality of recesses to securely hold objects onto the table top when in the horizontal position.

* * * * *